US006502066B2

(12) United States Patent
Plumpe

(10) Patent No.: US 6,502,066 B2
(45) Date of Patent: Dec. 31, 2002

(54) SYSTEM FOR GENERATING FORMANT TRACKS BY MODIFYING FORMANTS SYNTHESIZED FROM SPEECH UNITS

(75) Inventor: Michael D. Plumpe, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/824,142

(22) Filed: Apr. 2, 2001

(65) Prior Publication Data

US 2001/0021904 A1 Sep. 13, 2001

Related U.S. Application Data

(63) Continuation of application No. 09/200,383, filed on Nov. 24, 1998.

(51) Int. Cl.[7] ..... G10L 19/02
(52) U.S. Cl. ..... 704/209; 704/220; 704/221
(58) Field of Search ..... 704/209, 268, 704/220, 221, 278

(56) References Cited

U.S. PATENT DOCUMENTS

| | | | | |
|---|---|---|---|---|
| 4,424,415 | A | 1/1984 | Lin | 704/209 |
| 5,146,539 | A | 9/1992 | Doddington et al. | 704/241 |
| 5,313,555 | A | 5/1994 | Kamiya | 704/233 |
| 5,325,462 | A | 6/1994 | Farrett | 704/258 |
| 5,625,747 | A | 4/1997 | Goldberg et al. | 704/243 |
| 5,913,193 | A | 6/1999 | Huang et al. | 704/258 |
| 6,101,469 | A | 8/2000 | Curtin | 704/258 |

OTHER PUBLICATIONS

"Robust N–best Formant Tracking", Proceedings of the 4th European Conference on Speech Communication and Technology, vl, p. 737–740, 1995, by P. Schmid and E. Barnard.

R.W. Schafer, L.R. Rabiner, "System for Automatic Formant Analysis of Voiced Speech", *Journal of the Acoustical Society of America*, 47, 634–648, 1970.

P. Zolfaagheri and R. Robinson, "Formant Analysis Using Mixtures of Gaussians", *Proceedings of ICSLP*, p. 1229–1232, 1996.

Y. Laprie, "A New Paradigm for Reliable Automatic Formant Tracking", *Proceedings of ICASSP*, vol. 2, 1994, pp. II/201–4.

IEEE Transactions on "Audio and Electroacoustics" vol. AU–21, No. 2, pp. 69–79, Apr. 1973, Markel and Gray, "On Auto Correlation Equations to Speech".

The Journal of the Acoustical Society of America. Automatic Formant Tracking by a Newton–Raphson Technique, J.P. Olive, Apr. 14, 1971 pp 661–670.

The Journal of the Acoustical Society of America. Automatic Reduction of Vowel Spectra: An Analysis–By–Synthesis Method and Its Evaluation. By Allan P. Paul et al., vol. 36, No. 2, Feb. 1964, pp. 303–308.

The Journal of the Acoustical Society of America. Reduction of Speech Spectra by Analysis–By Synthesis Techniques. By C.G. Bell et al. vol. 22, No. 12, Dec. 1961 pp. 1725–1736.

*Primary Examiner*—Tālivaldis Ivars Šmits
*Assistant Examiner*—Donald L. Storm
(74) *Attorney, Agent, or Firm*—Christopher L. Holt; Westman, Champlin & Kelly, P.A.

(57) ABSTRACT

Formants, corresponding to input speech units based either on a known text or the results of a speech recognition procedure, are generated from a formant synthesizer. A frequency response is generated based on the synthesized formants. A second frequency response is generated based on a speech signal which is received and which corresponds to utterances of speech units. The synthesized formants are modified based on a comparison of the frequency response corresponding to the synthesized formants and specific proportional characteristics of a frequency response of the input speech signal. In one illustrative embodiment, the comparison is then recalculated and further modifications are made accordingly to improve accuracy. In one illustrative embodiment, time aligning and frequency warping are utilized as modification functions.

32 Claims, 7 Drawing Sheets

FIG. 10
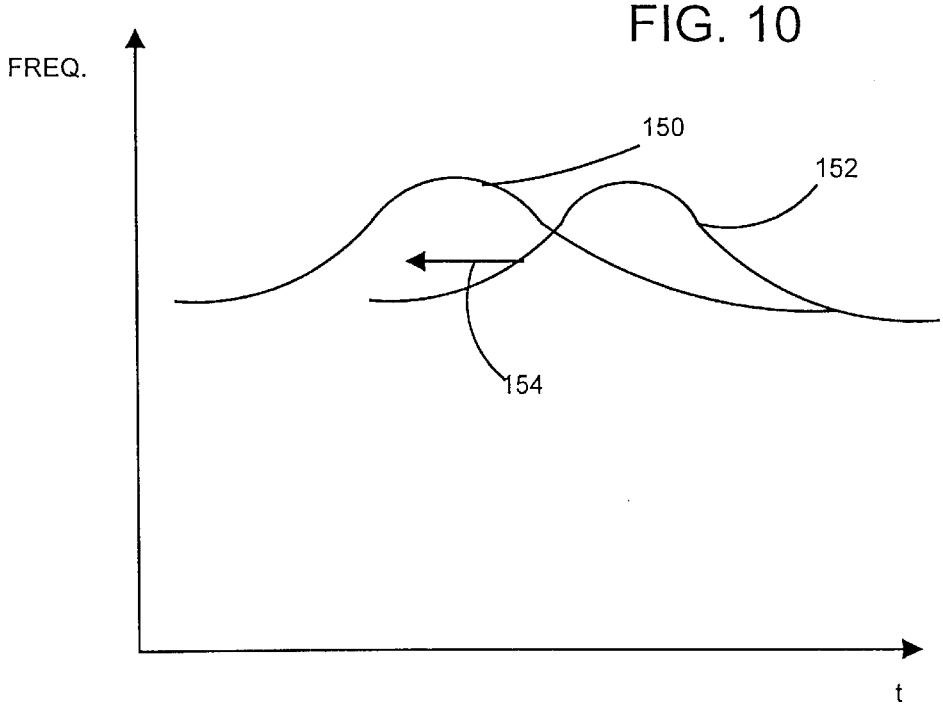
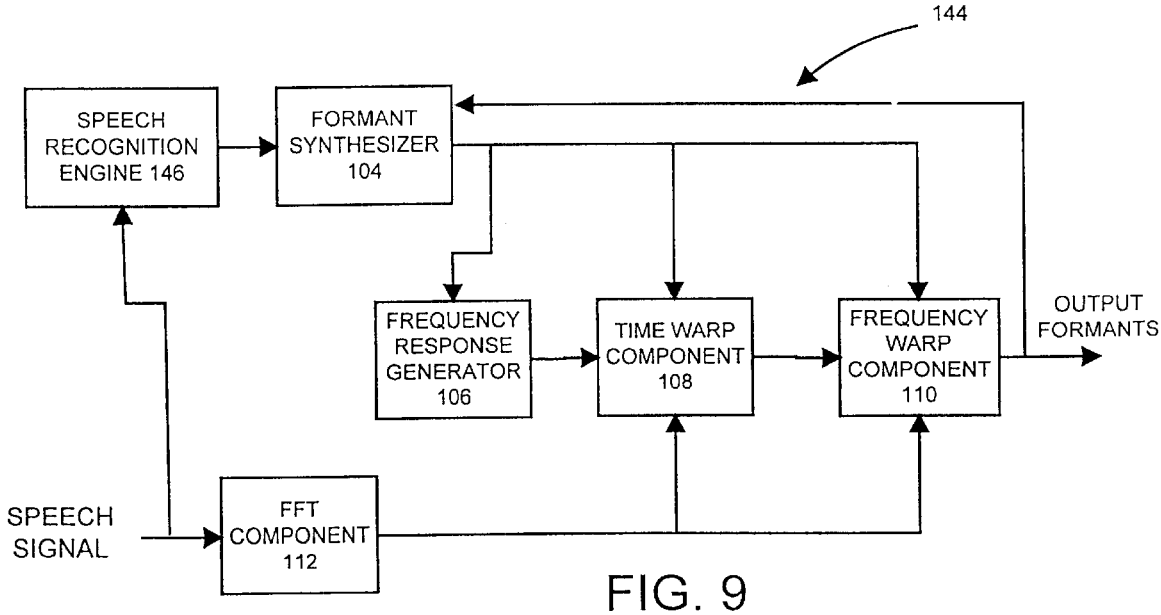
FIG. 9

SYSTEM FOR GENERATING FORMANT TRACKS BY MODIFYING FORMANTS SYNTHESIZED FROM SPEECH UNITS

This application is a continuation U.S. patent application Ser. No. 09/200,383 to Plumpe, filed Nov. 24, 1998 and entitled "SYSTEM FOR GENERATING FORMANT TRACKS USING FORMANT SYNTHESIZERS".

BACKGROUND OF THE INVENTION

The present invention deals with formant tracking. More specifically, the present invention deals with formant tracking using a formant synthesizer.

The human vocal tract has a number of resonances. The speaker can change the frequency of these resonances to produce different sounds. For example, the speaker can change the configuration of the vocal tract by movement of the tongue or lips and the inclusion or exclusion of the nasal tract. These resonances are excited by the movement of the vocal cords or noise generated at a constriction of the vocal tract. Each sound has an associated set of resonances, and when sounds are strung together in a time wise fashion, they form words. These resonances are referred to as formants.

In speech analysis, the first three resonances (or formants) are generally of primary interest. Higher frequency formants vary minimally, and are usually based on the length of the particular speaker's vocal tract. Thus, the higher frequency formants do not carry a great deal of information with respect to the words being spoken.

The formants associated with each sound can vary a great deal from speaker-to-speaker. Further, formants can vary from one utterance to another, even for the same speaker. Thus, tracking formants is quite difficult.

Formant trackers are conventionally used to identify and track formants in human speech. This information is useful in speech analysis. Standard formant trackers perform linear prediction on the speech signal in order to identify the resonances or formants associated with the speech signal. In other words, at some point in time, n, the speech signal is represented as follows:

$$s(n) = a_1 * s(n-1) + a_2 * s(n-2) + \ldots + x(n) = \sum_{i=1}^{p} a_i s(n-i) + x(n)$$

where s(n) is the speech signal, x(n) is the excitation, and the coefficients $a_i$ are the impulse response of the vocal tract.

The roots of the equation represent poles, and a single pole pair has a specific frequency response. Thus, each formant track (each set of three formants) corresponds to three pole pairs.

A conventional formant tracker divides the speech signal into consecutive frames having a predetermined duration (such as 10 millisecond). By taking the roots of the filter defined by Equation 1, the resonances for each frame can be found. However, for each 10 millisecond frame, the linear prediction algorithm may identify a relatively large number (such as seven) of resonances. Although this number can be controlled in performing the linear prediction calculations, more than three resonances must be calculated, in order to model any noise or non-linearities present in the signal. The formant tracker then attempts to find smooth paths for three primary formants at each frame, given the seven resonances identified by the linear prediction algorithm.

Conventional formant trackers have problems. The primary problem associated with conventional formant trackers is that they fail to select the proper resonances identified by linear prediction, and thus fail to find the proper formants. Also, conventional formant trackers can provide discontinuous formant tracks based on inaccurate identification of resonances.

Formant synthesizers are a type of speech synthesizer used to produce speech from a phonetic description of an utterance. Formant synthesizers are generally trained by phoneticians, who in essence codify their knowledge of speech production into the mathematical codes and data tables that the formant synthesizer uses to generate formants from a phonetic representation of an utterance.

During synthesis, the input text is typically broken into the phonemic units, and those units are provided to the formant synthesizer. The formant synthesizer then generates formants or formant tracks which are reasonable and expected based on the speech units input into the synthesizer. Normally, the formant tracks are then used to create synthetic speech.

SUMMARY OF THE INVENTION

Formants corresponding to input speech units are generated from a formant synthesizer. A frequency response is generated based on the synthesized formants. A second frequency response is generated based on a speech signal which is received and which corresponds to utterances of the speech units. The synthesized formants are modified based on a comparison of the frequency response corresponding to the synthesized formants and the frequency response of the input speech signal.

BRIEF DESCRIPTION OF THE DRAWINGS

FIG. 9 is a block diagram of another embodiment of a formant tracker, which can be used to improve the formant synthesizer, in accordance with another aspect of the present invention.

FIG. 10 is a graph of frequency versus time illustrating warping in the formant domain in accordance with one aspect of the present invention.

DETAILED DESCRIPTION OF THE PREFERRED EMBODIMENTS

Figure 1:
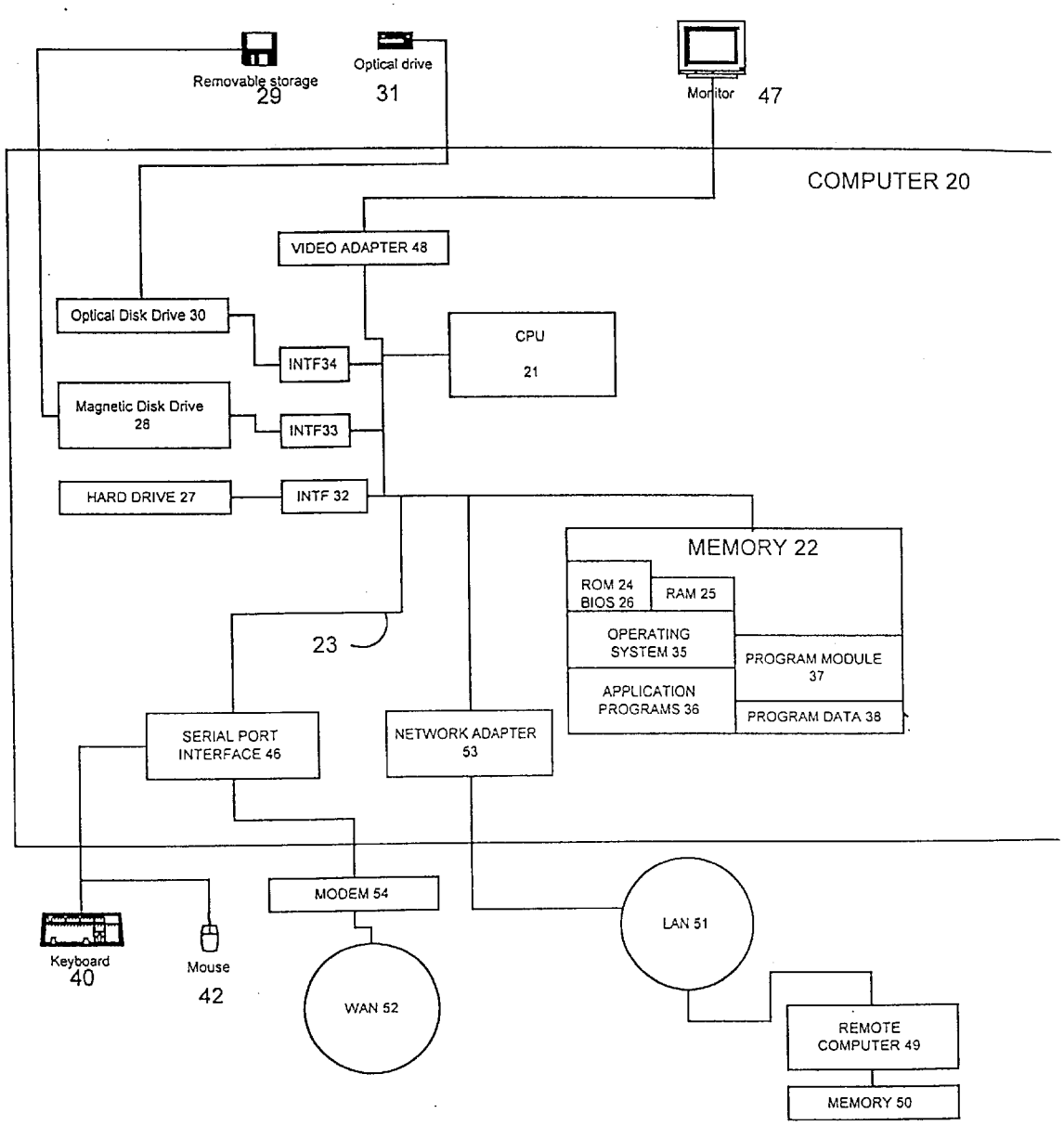
FIG. 1 is a block diagram of one illustrative environment in which the present invention can be used.

FIG. 1 and the related discussion are intended to provide a brief, general description of a suitable computing environment in which the invention may be implemented. Although not required, the invention will be described, at least in part, in the general context of computer-executable instructions, such as program modules, being executed by a personal computer. Generally, program modules include routine programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

With reference to FIG. 1, an exemplary system for implementing the invention includes a general purpose computing device in the form of a conventional personal computer 20, including processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read only memory (ROM) 24 a random access memory (RAM) 25. A basic input/output 26 (BIOS), containing the basic routine that helps to transfer information between elements within the personal computer 20, such as during start-up, is stored in ROM 24. The personal computer 20 further includes a hard disk drive 27 for reading from and writing to a hard disk (not shown), a magnetic disk drive 28 for reading from or writing to removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, magnetic disk drive interface 33, and an optical drive interface 34, respectively. The drives and the associated computer-readable media provide nonvolatile storage of computer readable instructions, data structures, program modules and other data for the personal computer 20.

Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs), read only memory (ROM), and the like, may also be used in the exemplary operating environment.

A number of program modules may be stored on the hard disk, magnetic disk 29, optical disk 31, ROM 24 or RAM 25, including an operating system 35, one or more application programs 36, other program modules 37, and program data 38. A user may enter commands and information into the personal computer 20 through input devices such as a keyboard 40, pointing device 42 and microphone 62. Other input devices (not shown) may include a joystick, game pad, satellite dish, scanner, or the like. These and other input devices are often connected to the processing unit 21 through a serial port interface 46 that is coupled to the system bus 23, but may be connected by other interfaces, such as a sound card, a parallel port, a game port or a universal serial bus (USB). A monitor 47 or other type of display device is also connected to the system bus 23 via an interface, such as a video adapter 48. In addition to the monitor 47, personal computers may typically include other peripheral output devices such as speaker 45 and printers (not shown).

The personal computer 20 may operate in a networked environment using logic connections to one or more remote computers, such as a remote computer 49. The remote computer 49 may be another personal computer, a server, a router, a network PC, a peer device or other network node, and typically includes many or all of the elements described above relative to the personal computer 20, although only a memory storage device 50 has been illustrated in FIG. 1. The logic connections depicted in FIG. 1 include a local are network (LAN) 51 and a wide area network (WAN) 52. Such networking environments are commonplace in offices, enterprise-wide computer network intranets and the Internet.

When used in a LAN networking environment, the personal computer 20 is connected to the local area network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a network environment, program modules depicted relative to the personal computer 20, or portions thereof, may be stored in the remote memory storage devices. It will be appreciated that the network connections shown are exemplary and other means of establishing a communications link between the computers may be used.

Figure 2:
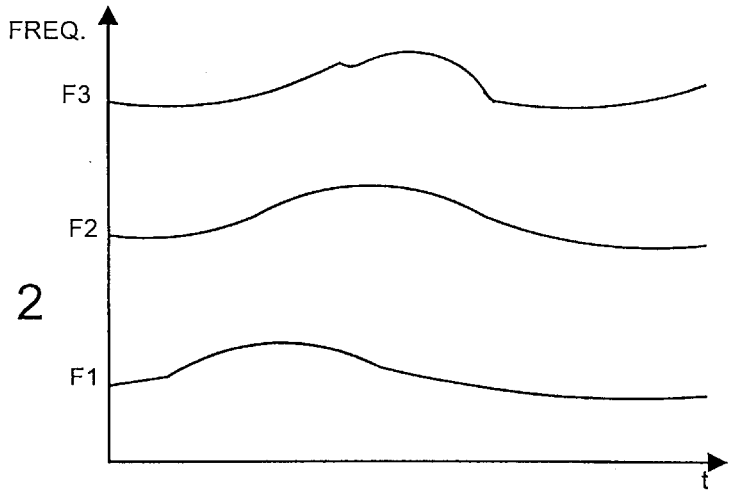
FIG. 2 is a graph of frequency versus time showing three formants of interest.

FIG. 2 is a plot of frequency versus time and illustrates three primary formants of interest labeled F1, F2 and F3. Formants F1, F2 and F3 represent the three primary resonant frequencies in the vocal tract associated with a certain utterance or unit of speech. With different units of speech, the tongue, lips, nasal track, etc., are manipulated by the speaker in order to vary the frequency of the three primary resonances or formants of interest. Higher formants are typically based on the length of the speaker's vocal tract and do not change a great deal with movement of the tongue, lips, nasal tract, etc. Therefore, they do not carry a great deal of information with respect to the words spoken.

In any case, formant trackers attempt to track formants associated with a speech signal in order to provide information for speech analysis. As discussed in the Background portion of the specification, conventional formant trackers use linear prediction in order to identify formants F1, F2 and F3. In linear prediction, time is broken up into small frames, such as 10 millisecond frames. Within each frame, the formant tracker attempts to identify a number of resonances. The formant tracker then chooses a subset of those resonances and attempts to draw a smooth line connecting the chosen resonances (from time frame to time frame) in order to obtain the three formant tracks illustrated in FIG. 2. However, this has a number of difficulties and disadvantages, which are mentioned in the Background portion of the specification.

Figure 3:
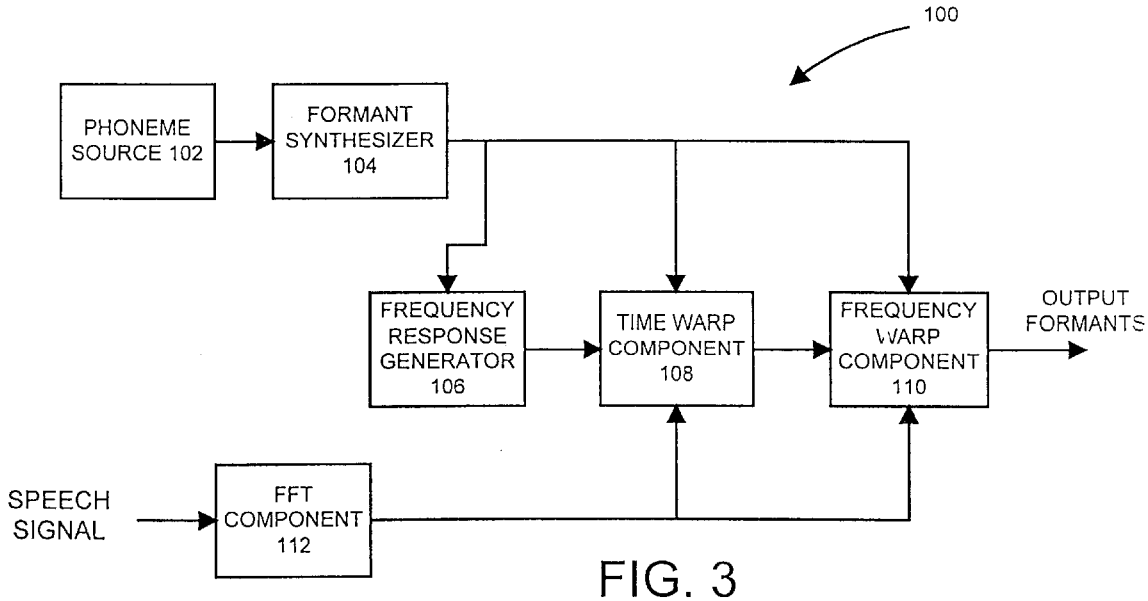
FIG. 3 is a block diagram of one illustrative embodiment of a formant tracker in accordance with one aspect of the present invention.

FIG. 3 is a block diagram of a formant tracker 100 in accordance with one aspect of the present invention. Formant tracker 100 includes phoneme source 102, formant synthesizer 104, frequency response generator 106, time warp component 108, frequency warp component 110, and fast fourier transform component 112.

It should be noted that the various components of formant tracker 100 can be implemented in various components of computer 20. For instance, phoneme source 102 can simply be any of the data storage devices shown in FIG. 1, which contain the phonemes associated with the speech utterances in the speech signal. Formant synthesizer 104, time warp component 108 and frequency warp component 110 can also be hardware modules or software components stored in any of the data storage devices shown in FIG. 1, and executed on processor 21, or another dedicated processor. Further, frequency response generator 106 and fast fourier transform component 112 can be implemented in the hardware or software components illustrated in FIG. 1, or combinations thereof.

Figure 5:
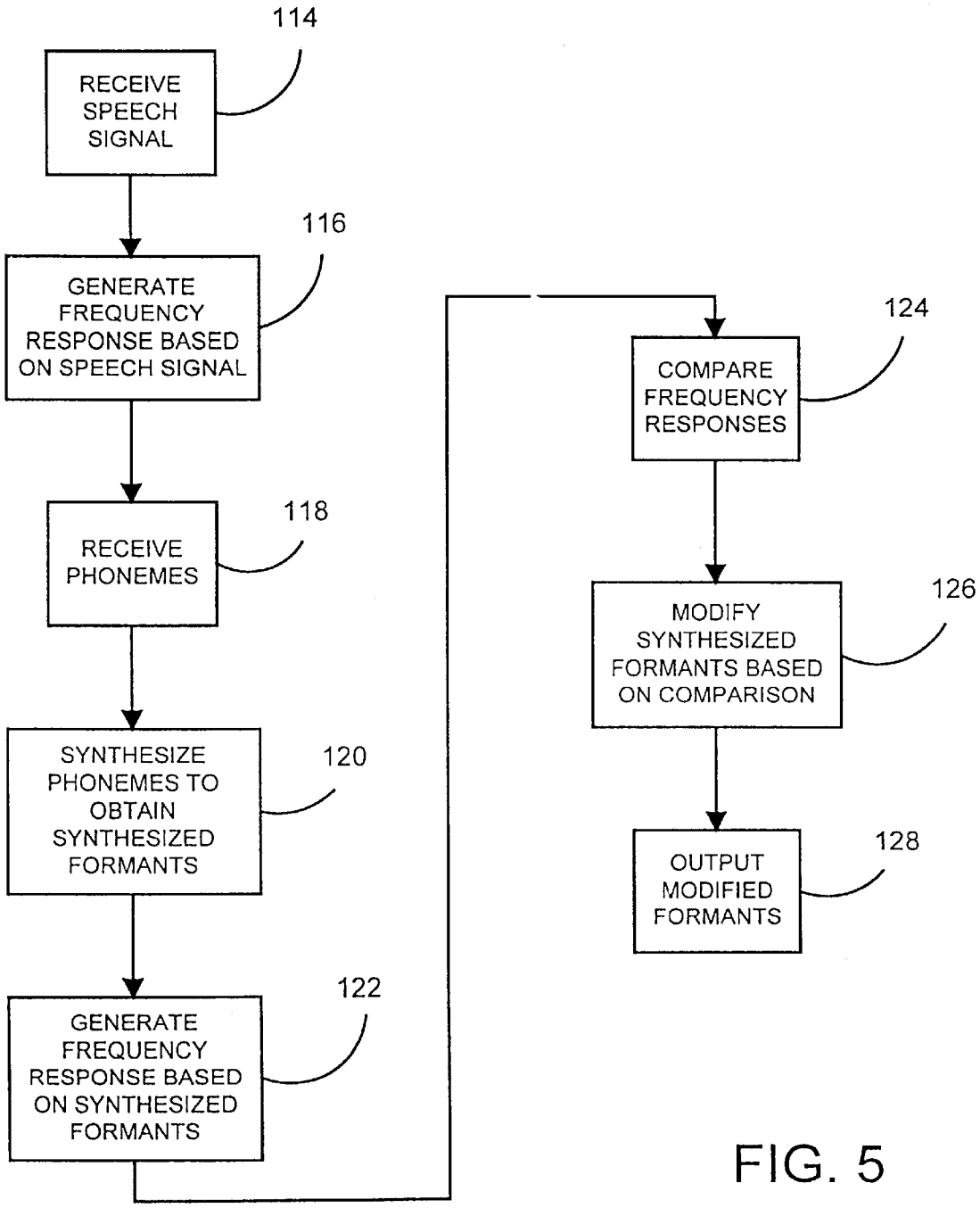
FIG. 5 is a flow diagram illustrating operation of the formant tracker shown in FIG. 3 in accordance with one aspect of the present invention.

FIG. 5 is a flow diagram illustrating operation of formant tracker 100. FIGS. 3 and 5 will be discussed together.

A speech signal generated by a speaker is input into fast fourier transform component 112. This is indicated by block 114 in FIG. 5. Fast fourier transform component 112 generates a spectrogram which includes a set of frequencies, and associated amplitudes, which are present in the speech signal during each time interval. This is indicated by block 116 in FIG. 5. The frequency response information is provided to time warp component 108 and frequency warp component 110.

Figure 4A:
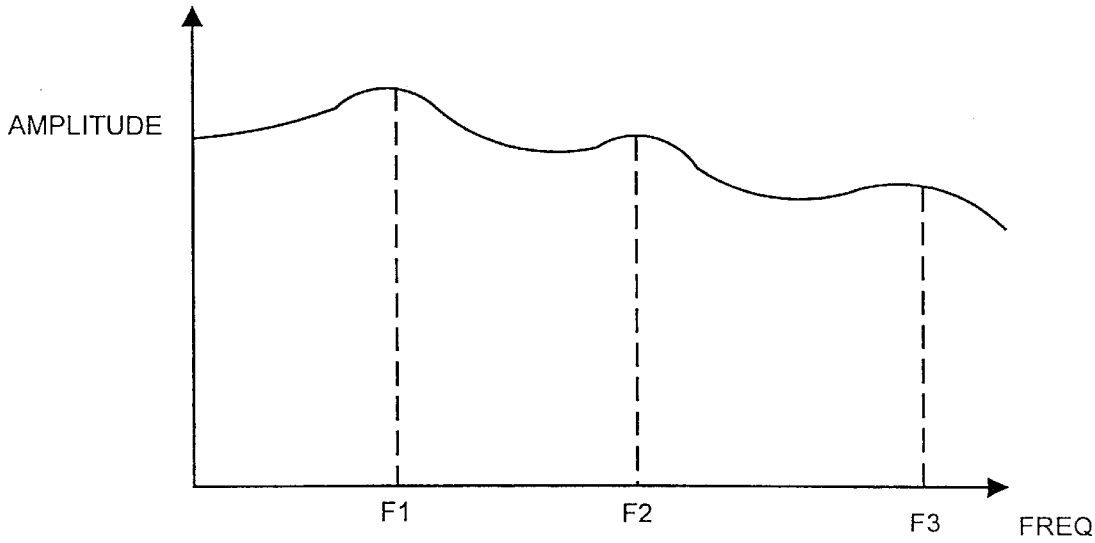
FIGS. 4A and 4B are graphs of amplitude plotted against frequency for formants based on a speech signal and synthesized formants, respectively.

FIG. 4A illustrates one set of frequencies provided by fast fourier transform component 112 based on the input speech signal. FIG. 4A is a graph of amplitude versus frequency and illustrates the frequencies associated with formants F1, F2 and F3 during a single time interval.

At the same time, phonemes corresponding to the speech units in the speech signal are provided from phoneme source 102 to formant synthesizer 104. This is indicated by block 118. The phonemes provided from phoneme source 102 can simply be a list of known phonemes if the speaker generating the speech signal is reading from a known text. Alternatively, phoneme source 102 can be a speech recognizer if the speaker is speaking from an unknown text. The latter embodiment is discussed in greater detail with respect to FIG. 9.

Formant synthesizer 104 is illustratively a conventional formant synthesizer which is trained, in a known manner, and conventionally used for text-to-speech systems. Thus, formant synthesizer 104 has been trained by one of more phoneticians to generally associate formants with the input speech units (such as phonemes). Therefore, upon receiving a phoneme, formant synthesizer 104 provides, at its output, several sets of formants associated with various points in time during that phoneme. In one illustrative embodiment, formant synthesizer 104 provides at its output a set of frequencies F1, F2 and F3 corresponding to the three formants of interest, along with a set of corresponding bandwidths B1, B2 and B3. The frequencies and bandwidths correspond to the three formants of interest, such as those shown in FIG. 2. This is indicated by block 120.

The output from formant synthesizer 104 is provided not only to frequency response generator 106, but also to time warp component 108 and frequency warp component 110.

Figure 4B:
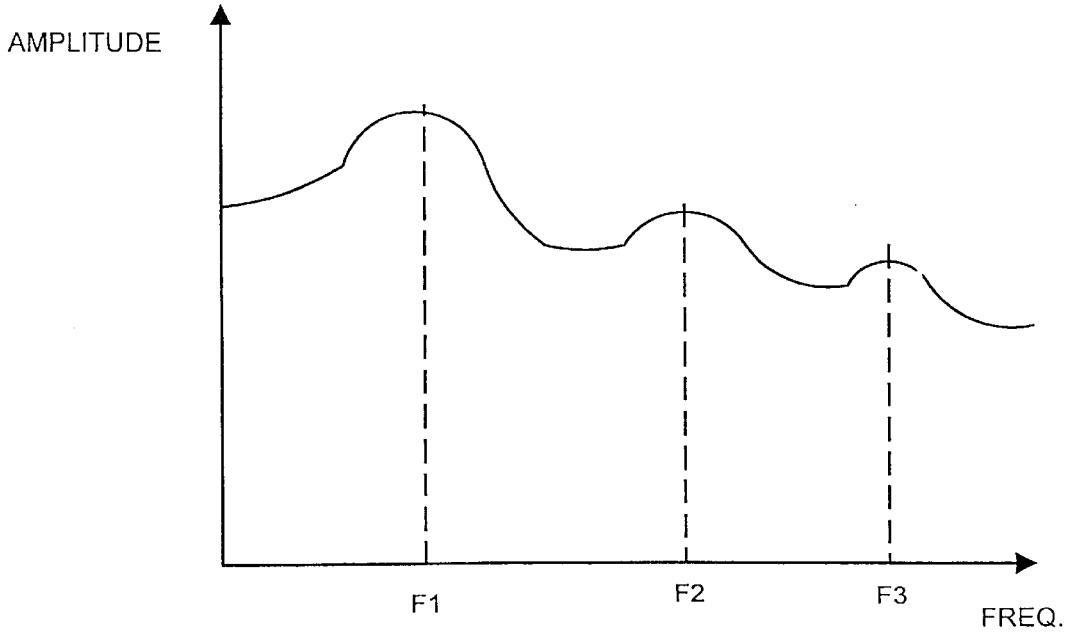

Frequency response generator 106 generates a frequency response corresponding to the formants output by formant synthesizer 104. This is indicated by block 122. One illustrative frequency response at a single time is shown in FIG. 4B which is a graph of its amplitude plotted against its frequency. FIG. 4B illustrates formant frequencies F1, F2 and F3 corresponding to the formants provided by formant synthesizer 104.

Once the frequency responses based on the synthesized formants and the frequency responses based on the speech signal are generated, they are compared with one another. This is indicated by block 124 in FIG. 5. Based on the comparison, the synthesized formants are modified and the modified formants are output from formant tracker 100. This is indicated by blocks 126 and 128.

Figure 6:
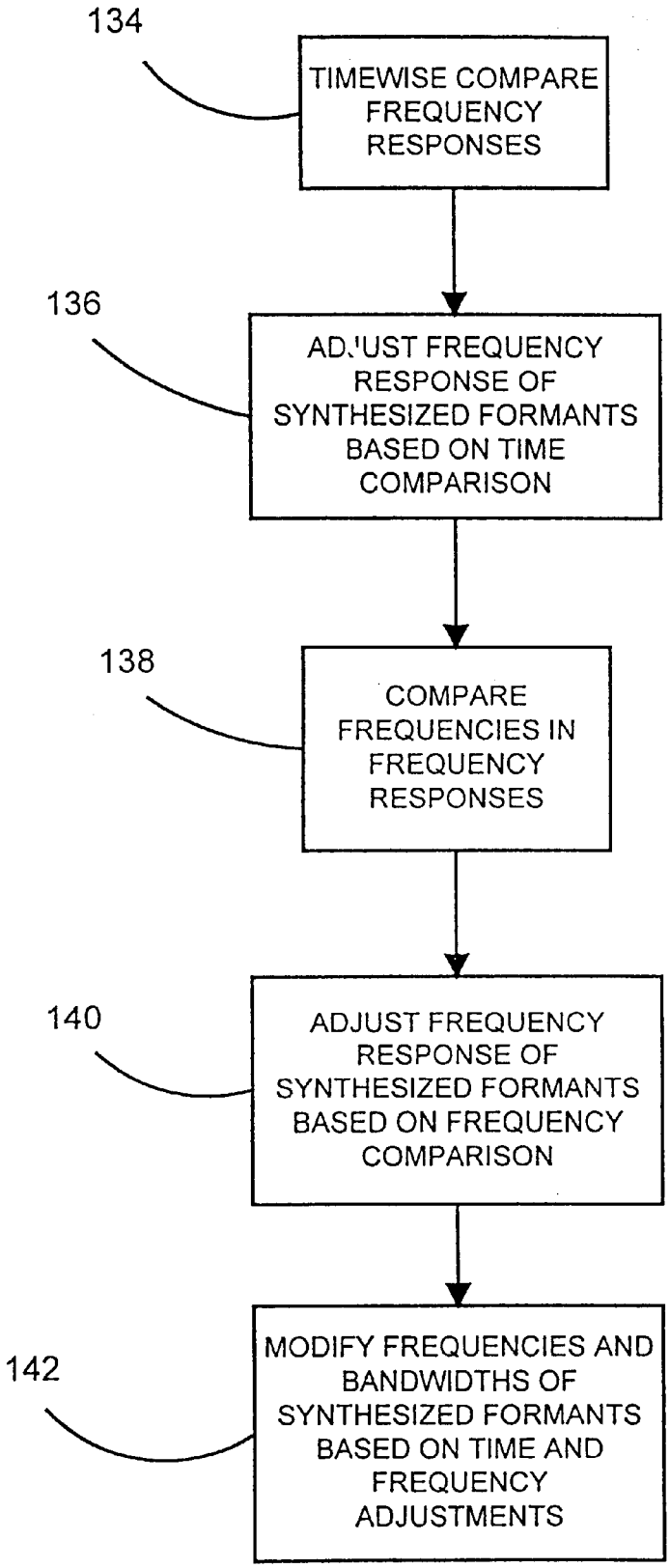
FIG. 6 is a more detailed flow diagram illustrating the adjustment of synthesized formants in accordance with one aspect of the present invention.

In one illustrative embodiment, the comparison of the frequency responses based on the synthesized formants and based on the speech signal are conducted in time warp component 108 and frequency warp component 110. FIG. 6 is a flow diagram illustrating operation of these components in greater detail. The remainder of FIG. 3 and FIG. 6 will be discussed in conjunction with one another.

Since as discussed previously, formants vary from person to person and even across repetitions of the same utterance for a single speaker, the formants output by formant synthesizer 104 and the actual formant values associated with the speech signal will likely be somewhat different. For instance, the time interval within which the formant frequency appears may be slightly shifted in the synthesized formants output by formant synthesizer 104 relative to the actual timing associated with the formant frequencies. Further, the formant frequencies output from formant synthesizer 104 may be slightly different from the actual formant frequencies. In order to modify the synthesized formants provided by formant synthesizer 104 to accommodate for these differences, time warp component 108 and frequency warp component 110 are provided.

Figure 7:
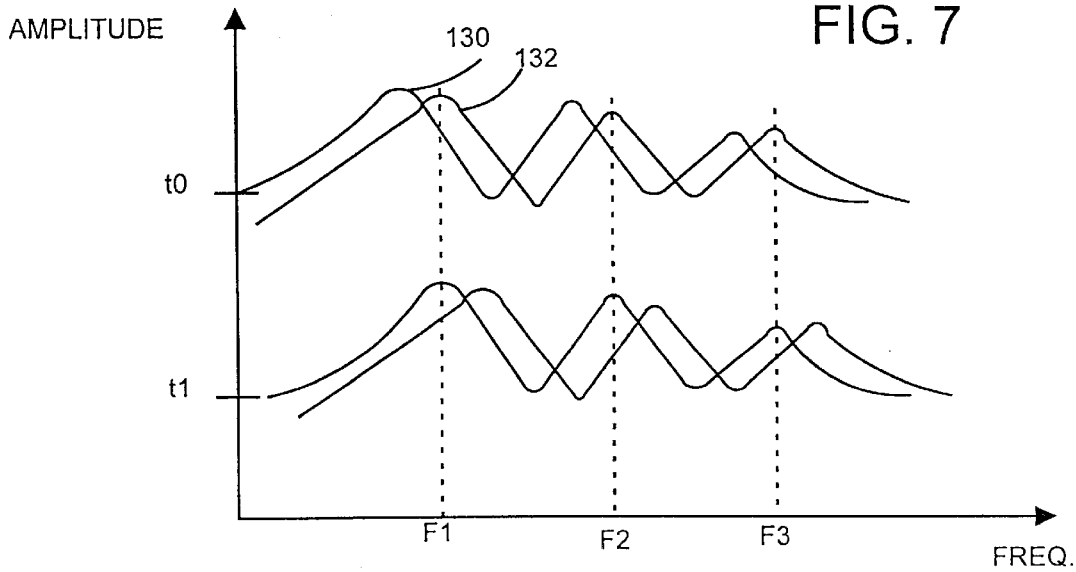
FIG. 7 is a graph of signal amplitude versus frequency showing time warping in accordance with one aspect of the present invention.

FIG. 7 is a plot of signal amplitude versus frequency for two formant tracks, at two discrete time intervals. In FIG. 7, formant track 130 corresponds to the frequency response based on the speech signal provided by fast fourier transform component 112. Formant track 132 corresponds to the frequency response based on the synthesized formants provided by formant synthesizer 104. It can be seen that, at time interval t0, formant track 132 slightly leads formant track 130. In fact, the formant frequency F1 occurs in the formant generated from the actual speech signal at time interval t1, rather than at time interval t0. However, the formant track 132 generated based on the synthesized formants estimates that formant frequency F1 occurs at time interval t0.

Therefore, by doing a timewise comparison of the two formant tracks 130 and 132, it can be seen that the value of formant track 132 more closely corresponds to the value of formant track 130 if formant track 132 is shifted forward one interval in time. After undergoing such a shift, formant track 132 will substantially overlie formant track 130 at frequency F1. The same analysis can be performed for frequencies F2 and F3.

In the embodiment illustrated by FIG. 7, it can be seen that shifting formant track 132 ahead one time interval will actually cause all three formant frequencies F1, F2 and F3 to more closely correspond to one another. Therefore, time warp component 108 determines that the formant provided by formant synthesizer 104 must actually be shifted forward one time interval in order to more closely correspond to the actual frequency response generated based on the speech signal. Time warp component 108 thus modifies the frequency response values corresponding to the synthesized formants provided by formant synthesizer 104 to timewise shift them based on the comparison illustrated in FIG. 7. This is indicated by blocks 134 and 136 in FIG. 6.

Figure 8:
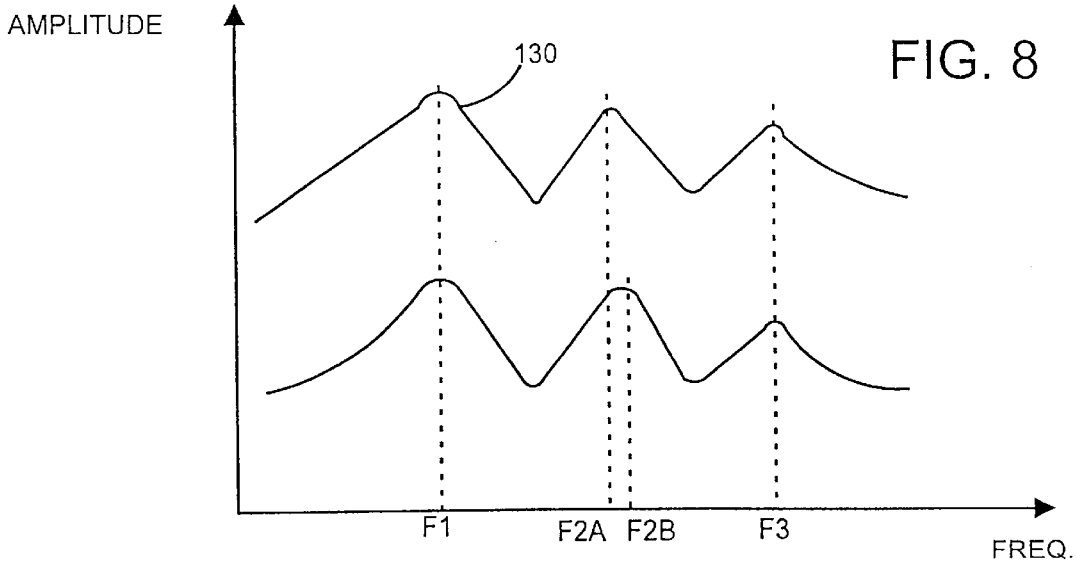
FIG. 8 is a graph of signal amplitude versus frequency illustrating frequency warping in accordance with one aspect of the present invention.

Once the formant tracks 130 and 132 are time aligned, the frequency responses can then be frequency aligned. FIG. 8 is a graph of signal amplitude versus frequency which plots formant track 130 and formant track 132. Recall that formant track 130 corresponds to the frequency response generated from the actual speech signal, while formant track 132 corresponds to the frequency response associated with the synthesized formants provided by formant synthesizer 104. In FIG. 8, it is assumed that formant tracks 130 and 132 have been time aligned. Even though the two tracks are time aligned, there still may be differences between the formant track 132 generated based on the synthesized formants and formant track 130 generated based on the actual speech signal. For example, FIG. 8 illustrates that the time alignment described with respect to FIG. 7 has substantially brought the first and third formants (F1 and F3) into alignment with one another. However, time alignment has still not aligned the second formant. For example, FIG. 8 illustrates that formant track 130 corresponds to a second formant frequency F2A, while formant track 132 corresponds to a second formant frequency F2B.

Therefore, frequency warp component 110 compares the two formant tracks and adjusts the synthesized formants provided by formant synthesizer 104 based on that comparison. This is indicated by blocks 138 and 140 in FIG. 6.

It can be seen from FIG. 8 that the frequency F2B corresponding to formant track 132 must be adjusted slightly so that it corresponds to frequency F2A in order to more closely correspond to the actual spectrum of the speech signal. Thus, frequency warp component 110 modifies the values provided by formant synthesizer 104 to reflect this difference. This is indicated by block 142 in FIG. 6.

Having been both time and frequency aligned, the modified formants are output from formant tracker 100.

FIG. 9 illustrates a second embodiment of a formant tracker 144 in accordance with one aspect of the present invention. Many items in formant tracker 144 are similar to those of formant tracker 100 shown in FIG. 3, and are similarly numbered. However, rather than simply having a phoneme source 102 providing phonemes to formant synthesizer 104, formant tracker 144 includes a speech recognizer engine 146. Speech recognizer engine 146 is preferably a conventional speech recognizer which receives the speech signal and generates speech units, such as phonemes, based on the speech signal. Therefore, in the embodiment in which the speaker is not speaking from a known text, speech recognizer engine 146 is used to recognize and generate the speech units (e.g., phonemes) used by formant synthesizer 104 to generate the synthesized formants.

Further, in the embodiment illustrated in FIG. 9, speech recognizer engine 146 can illustratively maintain a number of possible phoneme strings which correspond to the speech signal. Each of those phoneme strings are provided to the remainder of formant tracker 144. During time and frequency warping, components 108 and 110 determine which of the phoneme strings needed to be warped the least in order to correspond to the actual frequency response generated from fast fourier transform component 112, based on the speech signal. The phoneme string which needed to be warped the least is chosen as the correct phoneme string and the formants corresponding to that phoneme string are output from formant tracker 144 as the correct formants.

Further, speech recognizer engine 146 can also illustratively not only provide a plurality of strings of phonemes to formant synthesizer 104, but can also provide the probabilities associated with those strings, which can also be used by warping components to choose the proper phoneme string. In addition to the phonemes, the speech recognition engine 146 can also illustratively provide durations associated with each phoneme. This reduces the complexity of the time warping task, thereby making it more efficient and more accurate.

In addition, as illustrated in FIG. 9, formant tracker 144 can provide a feedback path from the output of frequency warp component 110 to formant synthesizer 104. In this way, the adjusted formant values, which are adjusted based on time and frequency warping, can be used by formant synthesizer 104 to adjust the formants associated with the speech units used to generate those formants. In this way, the time and frequency warping components 108 and 110 can be used to dynamically improve formant synthesizer 104 during operation.

It should be noted that, while the present description has proceeded with respect to time and frequency warping only, the present invention is not so limited. Rather, any desirable way of manipulating the synthesized formants generated by formant synthesizer 104 can be used, and is contemplated by the present invention. For example, manipulation can simply be performed in the formant domain. FIG. 10 is a plot of frequency versus time of two formants 150 and 152. The two formants can be compared against one another, and the entire formant can simply be shifted in order to achieve a closer match. For example, if formant 152 is being compared against formant 150, formant 152 can simply be shifted in the direction indicated by arrow 154 in order to more closely match formant 150.

Further, other formant manipulation techniques are contemplated as well. For example, formants can be manipulated in the Cepstral domain, the formants can be manipulated by calculating an error function which represents error between the two formants and indicates the amount by which formants need to be adjusted in order to reduce the error function. The present invention also contemplates identifying formant frequencies and correcting for spectral tilt. In other words, the spectral shape of sound generated by excitation of the vocal cords is different for different people. For most people, as frequency increases, amplitude decreases. This is referred to as spectral tilt. The present invention contemplates considering spectral tilt in manipulating formants as well. Further, the present invention contemplates manipulating the formants by either considering one frame at a time, or by considering multiple frames at the same time. Formant bandwidths can also be calculated and identified by calculating from a Gaussian, and directly calculating the 3 db roll-off points associated with the bandwidths. Thus, it can be seen that a wide variety of formant manipulations are contemplated by the present invention.

It can be seen that the present invention provides using a formant synthesizer in performing formant tracking. Formant synthesizers are typically trained to include a great deal of knowledge or information about formant frequencies corresponding to given speech units. Thus, the formants synthesized by a formant synthesizer will likely be quite close to the actual formants corresponding to the speech signal. In accordance with one aspect of the present invention, the synthesized formants are then slightly modified, based upon the spectral content of the speech signal, in order to more closely align the synthesized formants with the actual speech signal. This provides significant advantages over prior art formant trackers.

Although the present invention has been described with reference to preferred embodiments, workers skilled in the art will recognize that changes may be made in form and detail without departing from the spirit and scope of the invention.

What is claimed is:

1. A method of tracking formants corresponding to a speech signal, the method comprising:

obtaining a speech frequency response based on the speech signal;

providing speech units corresponding to the speech signal;

obtaining formants from a formant synthesizer, wherein the formants correspond to the speech units; and modifying the formants based on specific proportional characteristics of the speech frequency response to obtain modified formants for formant tracks.

2. The method of claim 1 and further comprising:

obtaining a formant frequency response associated with the formants obtained from the formant synthesizer.

3. The method of claim 2 wherein modifying comprises:

comparing the speech frequency response with the formant frequency response; and modifying the formants based on the comparison.

4. The method of claim 3 wherein comparing comprises:

comparing characteristics of the speech frequency response and the formant frequency response at a plurality of time instants; and modifying the formant frequency response at a plurality of time instants based on the comparison.

5. The method of claim 4 wherein modifying the formant frequency response comprises:

time aligning the formant frequency response at the plurality of time instants with the speech frequency response at the plurality of time instants.

6. The method of claim 4 wherein comparing comprises:

comparing frequencies in the speech frequency response and the formant frequency response; and modifying the formant frequency response based on the speech frequency response.

7. The method of claim 3 wherein providing speech units comprises:

performing speech recognition on the speech signal to obtain the speech units.

8. The method of claim 7 wherein performing speech recognition comprises:

providing a plurality of possible speech units corresponding to each of a plurality of intervals of the speech signal, and further comprising choosing one of the plurality of possible speech units based on the comparing step.

9. The method of claim 1 wherein the speech signal is generated based on a known text and wherein providing speech units comprises:

retrieving the speech units from a speech unit store based on the known text.

10. The method of claim 1 wherein obtaining formants from a formant synthesizer comprises:

having a formant synthesizer provide a set of frequencies and bandwidths indicative of the formants.

11. The method of claim 10 wherein modifying comprises:

modifying the frequencies and bandwidths indicative of the formants based on the speech frequency response.

12. The method of claim 1 and further comprising:

modifying the formant synthesizer based on the modified formants.

13. A formant tracker, comprising:

a first frequency response generator configured to receive a speech signal and provide a speech frequency response based on the speech signal;

a formant synthesizer configured to receive speech units associated with the speech signal and to provide formants corresponding to the speech units;

a second frequency generator coupled to the formant synthesizer and configured to generate a formant frequency response based on the formants; and a modification component coupled to the first and second frequency response generators and configured to modify the formants based on differences between specific proportional characteristics of the speech frequency response and the formant frequency response to provide modified formants.

14. The formant tracker of claim 13 wherein the modification component comprises:

a comparison component configured to compare the speech frequency response with the formant frequency response; and a modifier configured to modify the formants based on the comparison.

15. The formant tracker of claim 14 wherein the comparison component comprises:

a timing comparison component configured to compare timing characteristics of the speech frequency response and the formant frequency response; and wherein the modifier includes a timing modifier configured to modify the formant frequency response based on the comparison.

16. The formant tracker of claim 15 wherein the timing modifier is configured to time align the formant frequency response with the speech frequency response.

17. The formant tracker of claim 15 wherein the comparison component comprises:

a frequency comparison component configured to compare frequencies in the speech frequency response and the formant frequency response; and wherein the modifier includes a frequency modifier configured to modify the formant frequency response based on the speech frequency response.

18. The formant tracker of claim 14 and further comprising:

a speech recognition engine configured to perform speech recognition on the speech signal to obtain the speech units.

19. The formant tracker of claim 18 wherein the speech recognition engine is configured to provide a plurality of possible speech units corresponding to each of a plurality of intervals of the speech signal, and wherein the comparison component is configured to choose one of the plurality of possible speech units based on the comparison of the speech frequency response and the formant frequency response.

20. The formant tracker of claim 13 wherein the speech signal is generated based on a known text and further comprising:

a speech unit store, coupled to the formant synthesizer, storing the speech units corresponding to the known text.

21. The formant tracker of claim 14 wherein the formant synthesizer is configured to provide a set of frequencies and bandwidths indicative of the formants of the speech units.

22. The formant tracker of claim 21 wherein the modifier is configured to modify the frequencies and bandwidths indicative of the formants based on the speech frequency response.

23. The formant tracker of claim 13 wherein the formant synthesizer comprises:

a synthesizer modifying component, coupled to the modification component, configured to modify the formant synthesizer based on the modified formants.

24. A formant tracker, comprising:

a first frequency response generator configured to receive a speech signal and provide a speech frequency response at a first plurality of time instants based on the speech signal;

a formant calculation component configured to receive speech units associated with the speech signal and to provide continuous proposed formant frequencies and bandwidths at a second plurality of time instants corresponding to the speech units;

a second frequency response generator coupled to the formant calculation component and configured to provide a formant frequency response at the second plurality of time instants based on the proposed formant frequencies and bandwidths; and a modifier component, coupled to the first and second frequency response generators, configured to compare specific proportional characteristics of the speech frequency response and the formant frequency response and to proportionally modify the proposed formant frequencies and bandwidths based on differences between the speech frequency response and the formant frequency response obtained in the comparison.

25. The formant tracker of claim 24 wherein the speech signal is indicative of predefined speech and further comprising:

a speech unit store storing the speech units associated with the predefined speech such that the speech units are predefined speech units.

26. The formant tracker of claim 24 and further comprising:

a speech recognizer component configured to receive the speech signal and provide the speech units associated with the speech signal to the formant calculation component.

27. The formant tracker of claim 24 wherein the modifier component is configured to compare a first time evolution of the speech frequency response with a second time evolution of the formant frequency response and to adjust the second time evolution to more closely match the first time evolution.

28. The formant tracker of claim 27 wherein the modifier component is configured to adjust the second plurality of time instants to more closely match the first plurality of time instants.

29. The formant tracker of claim 27 wherein the modifier component is further configured to compare the speech frequency response with the formant frequency response after the second time evolution has been adjusted and to modify the proposed frequencies and bandwidths based on the comparison.

30. The formant tracker of claim 29 wherein the modifier component is configured to modify the proposed frequencies and bandwidths by applying a warping function to the proposed frequencies and bandwidths, the warping function being based on the comparison of the speech frequency response and the formant frequency response.

31. The formant tracker of claim 30 wherein the modifier component is configured to modify the proposed frequencies and bandwidths by modifying the proposed formant frequencies and bandwidths, recalculating the formant frequency response based on the modified frequencies and bandwidths, and comparing the recalculated formant frequency response to the speech frequency response.

32. The formant tracker of claim 31 wherein the modifier component is further configured to compare the recalculated formant frequency response with the speech frequency response and determines whether further modification of the proposed frequencies and bandwidths is desirable.

* * * * *

UNITED STATES PATENT AND TRADEMARK OFFICE

CERTIFICATE OF CORRECTION

PATENT NO. : 6,502,066 B2
DATED : December 31, 2002
INVENTOR(S) : Plumpe

It is certified that error appears in the above-identified patent and that said Letters Patent is hereby corrected as shown below:

Column 3,
Line 29, after "(ROM) 24" insert -- and --

Column 4,
Line 15, "are" should be -- area --
Line 38, "track" should be -- tract --

Column 5,
Line 42, "of" should be -- or --
Line 43, "3 db" should be -- 3 db --

Signed and Sealed this

Twenty-fourth Day of August, 2004

JON W. DUDAS
*Director of the United States Patent and Trademark Office*